US005889393A

United States Patent [19]

Wrathall

[11] Patent Number: 5,889,393

[45] Date of Patent: Mar. 30, 1999

[54] VOLTAGE REGULATOR HAVING ERROR AND TRANSCONDUCTANCE AMPLIFIERS TO DEFINE MULTIPLE POLES

[75] Inventor: Robert S. Wrathall, Scotts Valley, Calif.

[73] Assignee: Impala Linear Corporation, Sunnyvale, Calif.

[21] Appl. No.: 953,821

[22] Filed: Sep. 29, 1997

[51] Int. Cl.[6] ..... G05F 1/56

[52] U.S. Cl. ..... 323/282; 323/280

[58] Field of Search ..... 323/280, 281, 323/282, 268; 330/278, 284, 291–294

[56] References Cited

U.S. PATENT DOCUMENTS

| | | | |
|---|---|---|---|
| 4,218,647 | 8/1980 | Haas | 323/268 |
| 4,908,566 | 3/1990 | Tesch | 323/280 |
| 4,920,309 | 4/1990 | Szepesi | 323/267 |
| 5,168,209 | 12/1992 | Thiel | 323/313 |
| 5,514,947 | 5/1996 | Berg | 323/282 |
| 5,539,603 | 7/1996 | Bingham | 361/56 |
| 5,559,423 | 9/1996 | Harman | 323/277 |
| 5,648,718 | 7/1997 | Edwards | 323/274 |
| 5,672,959 | 9/1997 | Der | 323/273 |
| 5,731,694 | 3/1998 | Wilcox et al. | 323/287 |

*Primary Examiner*—Adolf Deneke Berhane
*Attorney, Agent, or Firm*—Terry McHugh

[57] ABSTRACT

A voltage regulator and method of voltage regulation utilizes an error amplifier and a transconductance amplifier together with a voltage reference, startup circuit and output load. The use of the transconductance amplifier allows the use of an arrangement of two poles and a zero such that the composite gain roll-off has a generally constant slope. One of the poles utilized in this stability scheme is the outer pole formed by the resistive-like load and its filter capacitor. Another pole and zero are generated in the error amplifier circuit. To decouple the noisy input supply voltage, sensitive parts of the circuit are powered by the regulated output voltage. A start circuit is provided to start up the output and voltage reference when no output voltage is present. The transconductance amplifier block has special characteristics which allow it to work to relatively high frequency, above the gain bandwidth product of the control loop. It is driven by a fully differential push-pull, class AB amplifier. The transconductance amplifier utilizes a current mirror approach to current sensing in the output device which utilizes cascode techniques for more accurate current sensing in the current mirror.

24 Claims, 4 Drawing Sheets

VOLTAGE REGULATOR HAVING ERROR AND TRANSCONDUCTANCE AMPLIFIERS TO DEFINE MULTIPLE POLES

TECHNICAL FIELD

The invention relates generally to methods and circuitry for regulating a voltage and more particularly to highly stable low dropout voltage regulators.

DESCRIPTION OF THE RELATED ART

Cellular phones, laptop computers, and other battery-powered electronic devices have a number of requirements relating to voltage regulation. For example, the regulated voltage must remain stable over the range of temperatures that are anticipated to be encountered by the electronic device. Moreover, the output voltage should remain stable over a wide range of load currents.

A low dropout (LDO) regulator is typically used in such electronic devices. An LDO regulator is one in which there is a small input-to-output voltage differential, e.g., 50 mV at 50 mA. An LDO regulator provides a regulated voltage output at a voltage level that approaches the input supply voltage to the regulator.

There are two approaches to designing LDO regulators. The traditional approach is to use bipolar technology. Bipolar circuits are generally higher gain and higher speed than circuits that are designed using metal oxide semiconductor (MOS) technology. However, the bipolar circuits are typically more expensive and are larger. Another concern is that bipolar circuits have a relatively high ground leg current. CMOS circuits, on the other hand, are typically smaller and have lower quiescent and ground leg currents. The concern with the CMOS approach is that the circuits have a slower response to transients.

U.S. Pat. No. 5,168,209 to Thiel, V, describes an LDO voltage regulator that utilizes the bipolar approach. The regulator includes a PNP output transistor, a voltage reference circuit, a gain circuit, and a current limit circuit. In order to provide alternating current (AC) stabilization, a small internal capacitor is coupled between the input of the gain circuit and the base of the PNP output transistor. Miller multiplication substantially increases the effective capacitance of the stabilization capacitor and introduces a zero into the gain-phase plot for the voltage regulator. The zero substantially cancels the pole of the regulator and increases the phase margin. As is well known in the art, "a pole" is a circuit that causes a decrease in the output voltage (e.g., −20 dB per decade) with an increase in frequency. The pole frequency ($f_{pole}$) having a load resistance ($R_L$) and a load capacitance ($C_L$) may be calculated as:

$$f_{pole} = \frac{1}{2\pi C_L R_L}$$

A "zero" refers to terms of the transfer function that cause an increase in the output voltage (e.g., +20 dB per decade) with an increase in frequency. When determining a gain roll-off of a circuit, a slope of +20 dB/decade will cancel a corresponding slope of −20 dB/decade. Thus, a zero of a properly designed circuit may compensate for a pole of the circuit.

U.S. Pat. No. 5,648,718 to Edwards utilizes a P-channel MOS field effect transistor (MOSFET) as a pass transistor for a voltage regulator. The regulator includes an error amplifier, an integrator with a switched capacitor, the pass transistor, and a feedback circuit. In one embodiment, the switched capacitor is driven by a voltage controlled oscillator that changes its frequency of oscillation in proportion to the output current. In another embodiment, the switched capacitor is driven by a current controlled oscillator having a frequency of oscillation that is proportional to the output current. When the output current demand is large, the effective resistance of the switched capacitor decreases, thereby changing the frequency of the zero to respond to the change in the frequency of the load pole. Conversely, the effective resistance is increased as the output current demand is decreased, so that the zero frequency again shifts with the pole frequency. As a result, the voltage regulator is stabilized.

Another patent which describes a voltage regulator of interest is U.S. Pat. No. 4,908,566 to Tesch. The Tesch regulator includes a staggered pole-zero compensation network. The compensation network introduces an incremental reduction in gain and an accompanying reduction in phase shift with increases in frequency, so that there is a substantial phase margin at the unity gain point of the transfer characteristic. This prevents the circuit from being driven into oscillation. The compensation network is a staggered resistor-capacitor network comprised of a number of resistor-capacitor circuits coupled in cascade between the output of a feedback error amplifier and the input of a buffer amplifier that drives the base of an output stage transistor.

While the known voltage regulators operate well for their intended purpose, enhanced performance is desired. What is needed is a highly stable voltage regulator that achieves significant gain at relatively high frequencies.

SUMMARY OF THE INVENTION

A voltage regulator and a method of regulating voltages establishes a number of poles and a compensating zero to define three components of composite roll-off of gain having a substantially constant slope. A first gain stage defines one of the components of gain roll-off. The first gain stage has an error amplifier with a first pole and a compensating zero. The error amplifier generates an error voltage output that is responsive to the difference between a reference input voltage and the feedback input voltage. The error voltage output is the input of a second gain stage that provides voltage-to-current conversion. In this invention, the second gain stage is a transconductance amplifier. The second gain stage is connected to receive the output of the error amplifier and to generate a regulated output current, which passes into the load circuit. A second pole is established by a load circuit. Because of the transconductance output stage, the current must be converted into a voltage for regulation, which is done in the load. In this implementation, the load becomes an integral and necessary part of the circuit. A feedback path provides negative feedback from the output circuit to the error amplifier, which establishes an output voltage level together with the voltage reference circuit.

The compensating zero and the two poles are set to define the three components of composite gain roll-off. In one embodiment, the first pole has a low pole frequency and the second pole has a pole frequency greater than the first pole. The compensating zero is ideally set at a third frequency that is greater than the frequency of the first pole and less than the pole frequency of the second pole. The sum of the gain roll-offs provides a generally constant slope, with different poles being dominant at different ranges of frequencies. The second pole crosses unity gain with an approximate ninety degree phase shift in order to create a stable circuit with little or no ringing. These poles are carefully considered in the design of the operating circuit. There are parasitic poles and zeros of the circuit. The frequencies of all of these poles and zeros are above the unity gain bandwidth of the control circuit.

The second stage, i.e., the transconductance amplifier, is formed using a differential amplifier which drives the gate of a pass element, such as a PMOS transistor. Current is sensed by a sense resistor and compared to the input voltage in the differential amplifier, which then drives the control gate of the pass element with a high gain signal to create a controlled and regulated output current. The action of the amplifier is to force the output current to be proportional to the input voltage.

The current sensing circuit may be formed using two scaled parallel transistors or pass elements, one large and the other small. The pass elements are designed so that the current in each is linearly related by the scale factor. The output of the smaller pass element is passed through a resistor such that the voltage which is developed across the resistor is proportional to the current in the smaller pass element, which is, in turn, proportional to the current in the larger pass element.

Because the two pass elements are not ideal current sources, they exhibit some voltage dependency. When the input voltage of the regulator approaches the output voltage of the regulator, the characteristics of the large pass element change. If a similar voltage is not placed across the terminals of the smaller pass element, there will be a departure from the ideal current scale factor between the two pass elements. Therefore, two devices have been added to the circuit to mirror the output voltage of the larger pass element to the output terminal of the smaller pass element. Two cascoded devices are added to achieve this mirroring, so that the currents in the two pass elements match over a wide voltage range as well as a current range.

In order to reduce the coupling of noise from the input power to the output, the sensitive parts of this regulator are powered from the regulated output. The error amplifier, the reference voltage generator and part of the transconductance amplifier are all run from the regulated voltage. This substantially reduces high frequency coupling into these circuits from the power supply. In order to do this, a start circuit must be implemented to turn on the regulator to apply power to the sensitive circuits before regulation is achieved.

An advantage of the invention is that the multi-pole and compensating zero design of the voltage regulator achieves a high speed response and a low ground leg current. Preferably, the circuitry uses CMOS device technology, so that an extremely low quiescent current is also achieved.

DETAILED DESCRIPTION

Figure 1:
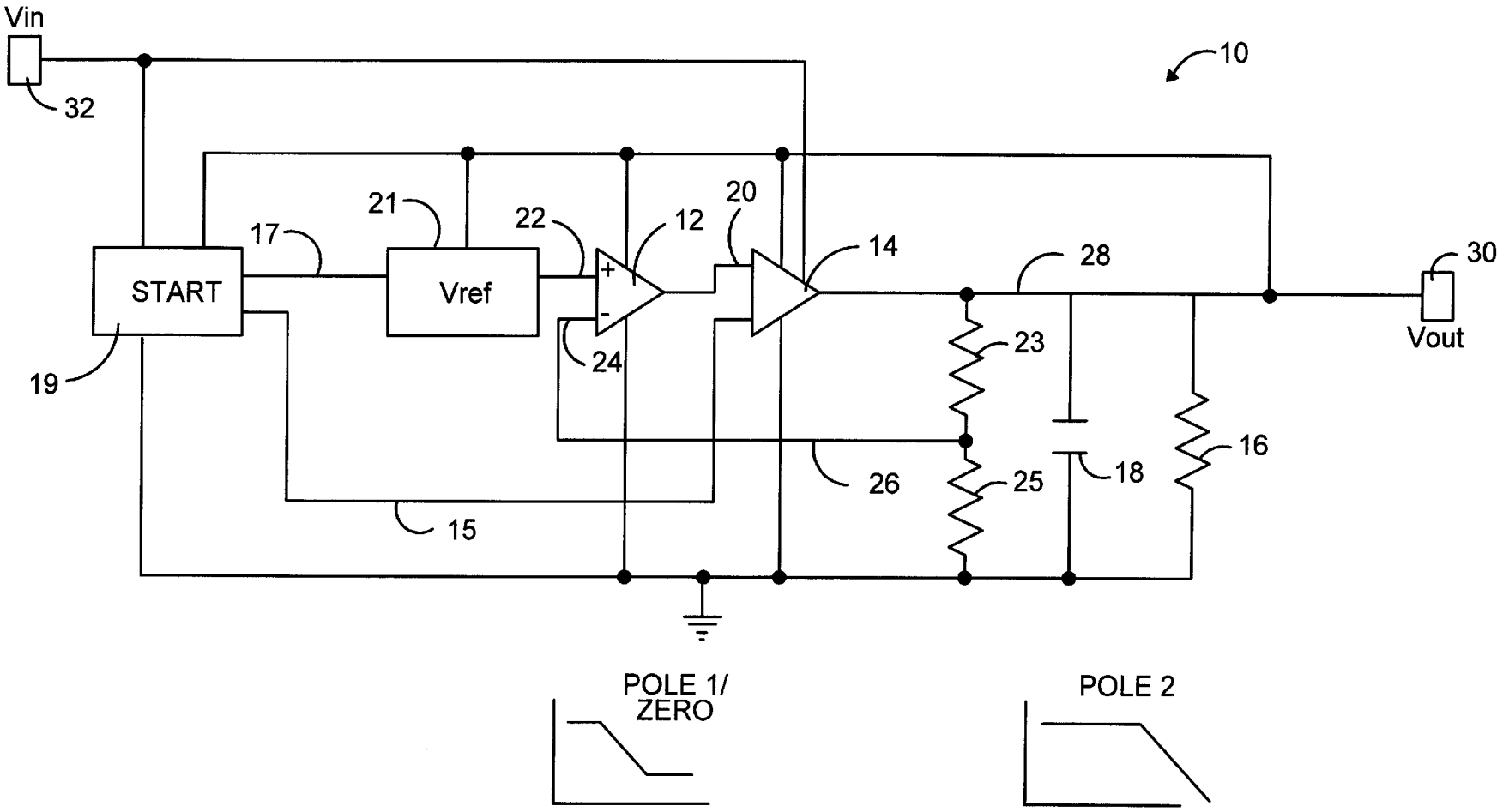
FIG. 1 is a schematical view of a voltage regulator having a voltage reference, a start circuit, an error amplifier and a voltage-to-current converter to drive an output circuit in accordance with the invention.

With reference to FIG. 1, a low dropout (LDO) voltage regulator 10 is shown as including a first gain stage 12 and a second gain stage 14 for driving an output circuit that includes a load resistor 16 and a filter capacitor 18. The first gain stage functions as an error amplifier having a voltage output 20 that is representative of the voltage differential between a reference voltage at input 22 and a feedback signal at input 24. A feedback path 26 connects the input 24 of the error amplifier to the output 28 of the second gain stage 14 through a resistor divider with resistor elements 23 and 25. The first gain stage 12 is a voltage mode amplifier that drives the second gain stage, which is a voltage-to-current converter. Thus, the output 28 of the second gain stage is shown as terminal Vout 30. As will be explained more fully below, the second gain stage 14 is a transconductance amplifier. The regulated output voltage 30 is used to power the sensitive circuit elements, the voltage reference circuit 21 and the error amplifier 12, and part of the transconductance amplifier 14. The start circuit 19 senses the voltage on a Vin 32 and provides start signals 17 and 15 to the reference circuit 21 and the transconductance amplifier 14 to start up the output.

The LDO voltage regulator 10 preferably utilizes CMOS technology. The inherent limitations of CMOS circuitry are overcome by utilizing a configuration of multiple "poles" and a "zero." As shown by the plots 34 and 36 below the circuitry of FIG. 1, the first gain stage 12 has a first pole and a compensating zero and the output circuit comprising the effective load resistor 16 and the filter capacitor 18 has a second pole. The load resistor 18 symbolically represents different load elements, such as microprocessors, logic circuits, amplifiers, etc., and may, in fact, be a real resistor.

The error amplifier of the first gain stage 12 includes a first pole and a zero. The pole is set at a low frequency and the zero is set such that it is lower than the lowest frequency of the output pole, i.e., the pole of plot 36. The voltage-to-current converter of the second gain stage 14 is capable of delivering substantial current to the load, but with a high output impedance. The high output impedance of the transconductance amplifier allows the output pole to be determined by the load resistance 16 and filter capacitance 18.

In the generalized feedback theory, the equation for output voltage is Vout=(Vref*Gain)/(1+Gain). In the limit of high gain, the approximation can be made that the "1" is disregarded, so that Vout=Vref. On the other hand, instability and oscillation are signified by the condition that the denominator approaches zero, i.e., Gain=−1. This can occur when Gain is a function of frequency. Returning to the voltage regulator of FIG. 1, there are three components of gain for the voltage regulator 10. The first component is provided by the first gain stage 12, the second component is provided by the transfer function of the second gain stage 14, and the third component is provided by the output circuit. In this case, it can be written $$\text{Gain} = G \cdot Gm\overline{Z\text{out}} - \frac{S\text{out} \cdot S\text{err} \cdot Sgm \cdot (S + S\text{zero})}{(S + S\text{out}) \cdot (S + S\text{err}) \cdot (S + Sgm) \cdot S\text{zero}}$$

where the denominators are the pole locations and zero location in the complex plane. If S is replaced by j*2πf, where f is frequency, then the frequency dependence of Gain can be determined. The frequency dependencies of the three components of gain are shown in FIG. 2.

As S becomes greater than each of the pole frequencies Serr, Sgm, and Sout, a ninety degree phase shift is introduced into the equation of the Gain. The zero will cancel out the effects of the first pole that is generated by the first gain stage 12. For stability, there cannot be a 180° phase shift when the gain is greater than or equal to 1, since this will lead to the condition in which Gain=−1. If this condition is approached, ringing and other large transient instabilities will occur. On the other hand, if the three poles and the compensating zero of the voltage regulator 10 are carefully designed, no instability results.

Figure 2:
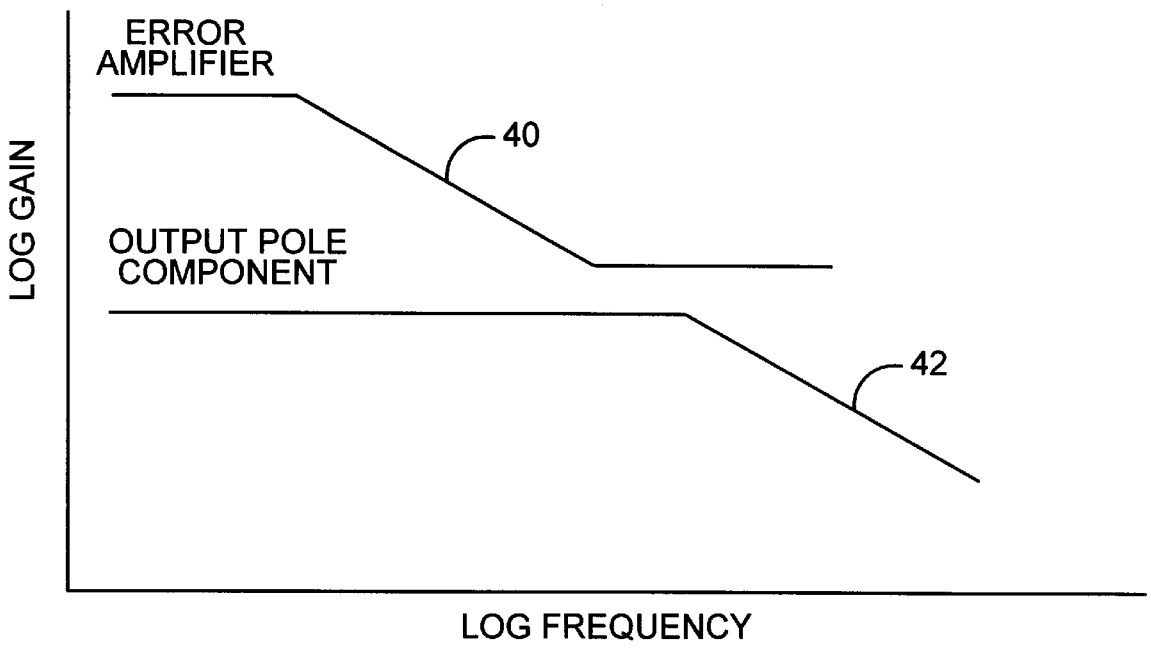
FIG. 2 is an illustration of the three components of roll-off of gain for the voltage regulator of FIG. 1.

In FIG. 2, the component of gain of the error amplifier is shown as component 40. The pole that is introduced into the error amplifier has a relatively low frequency. The sloped portion of the error amplifier component 40 is defined by the first pole. The compensating zero of the error amplifier has a higher frequency and cancels the effects of the first pole to create the flat portion that follows the sloped portion of the gain component 40.

While the compensating zero has a frequency greater than the pole frequency of the error amplifier, the frequency of the zero is usually less than or approximately equal to the lowest frequency of the second pole, i.e., the pole of the output circuit formed by the load resistor 16 and the filter capacitor 18 of FIG. 1. The output pole component of roll-off gain is shown at 42 in FIG. 2.

Figure 3:
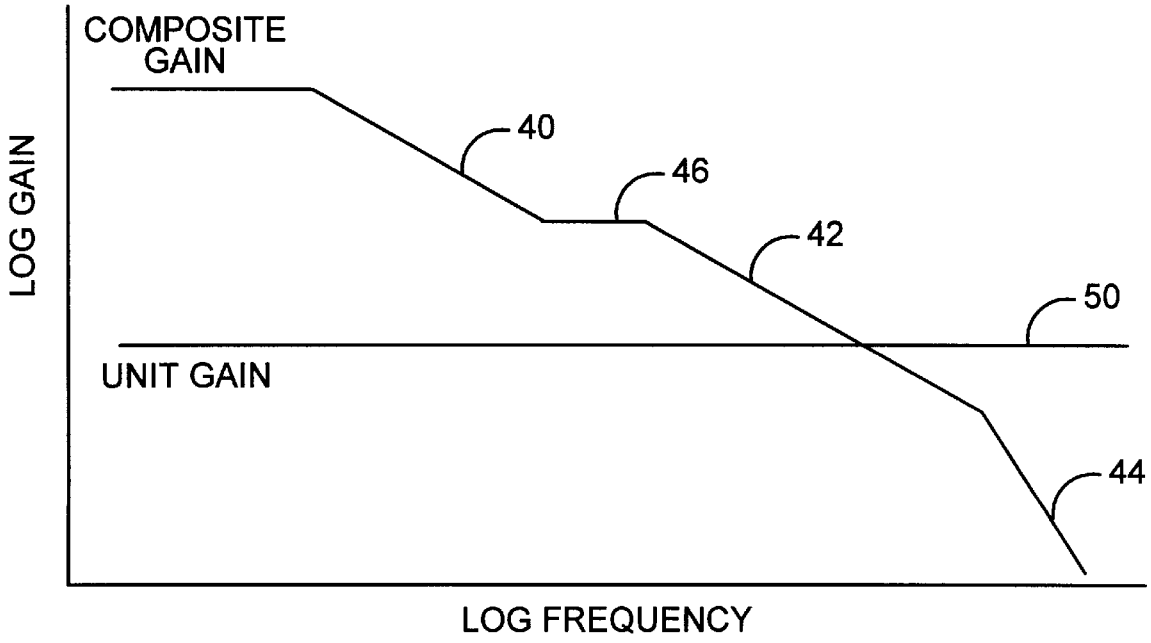
FIG. 3 is an illustration of a composite of the components of gain roll-off of FIG. 2.

Referring now to FIGS. 2 and 3, the slopes of the components 40 and 42 of roll-off gain are multiplied to determine the composite frequency dependency of gain for the voltage regulator 10. The composite roll-off gain is shown in FIG. 3 as including all of the rapidly sloping portions of the components 40 and 42. The flat portion 46 between components 40 and 42 is a result of the difference between the zero frequency of the error amplifier and the lowest frequency of the output pole. However, the composite gain of FIG. 3 has a generally constant slope. Portion 44 of FIG. 3 represents the parasitic poles associated with the circuitry. The joint between portion 42 and portion 44 must occur below the unity gain line, shown as line 50.

The frequency of the first parasitic pole of the transconductance amplifier represented by the portion 44 of FIG. 3 is significantly above the unity gain bandwidth, where line 50 cross line 42 of FIG. 3, of the voltage regulator. For example, this second pole may be above 5 MHz, with the crossing of the composite gain with unity gain being within the range of 2 MHz to 5 MHz. The voltage regulator is designed such that at moderate output capacitance 18, the second pole provided by the output circuit crosses unity gain with an approximate ninety degree phase shift. This arrangement provides a stable circuit with little or no ringing. The rapid roll-off of gain exhibited in FIG. 3 is advantageous, since it drops the gain below unity before the adverse effects of parasitic poles and zeros take effect.

Figure 4:
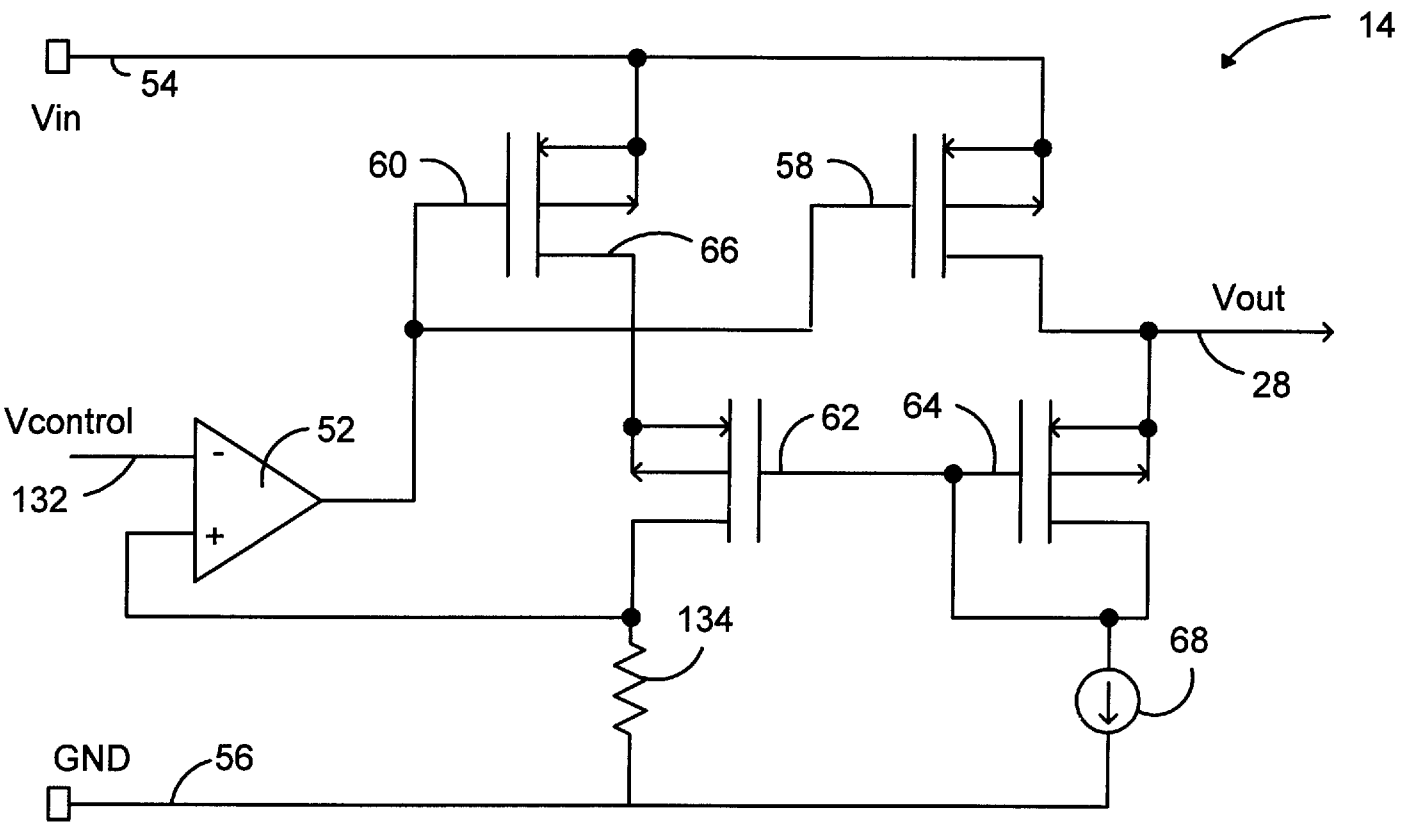
FIG. 4 is a schematical diagram of the second gain stage of the voltage regulator of FIG. 1.

The second gain stage, i.e., the transconductance amplifier, is shown in more detail in FIG. 4. As previously noted, this stage provides voltage-to-current conversion. The stage includes a fully differential push-pull amplifier 52 that operates nearly to the rails 54 and 56. While not critical, the Vin rail 54 may be 3.1 volts and the lower rail 56 may be electrical ground. The fully differential push-pull amplifier can source and sink significant current, which is important in order to drive the high capacitance of a large transistor 58 that operates with a small transistor 60 to provide a current mirror. The current mirror output stage may be utilized for current sensing. The ratio of the size of the large device 58 to the size of the small device 60 is maximized. The ratio may be 6,000:1. The second gain stage 14 includes a pair of cascode transistors 62 and 64. The cascode transistors are utilized in the second gain stage to enhance the accuracy of the current mirror. The current mirror reflects the voltage at the output 28 to the drain 66 of the small current mirror device 60 that is driven into linear operation when the output device 58 is in the linear region. This allows a more uniform current drain deep into the linear region of operation. Moreover, this has the advantageous effect of reducing the dropout voltage by increasing the gate voltage applied during saturation.

Figure 5:
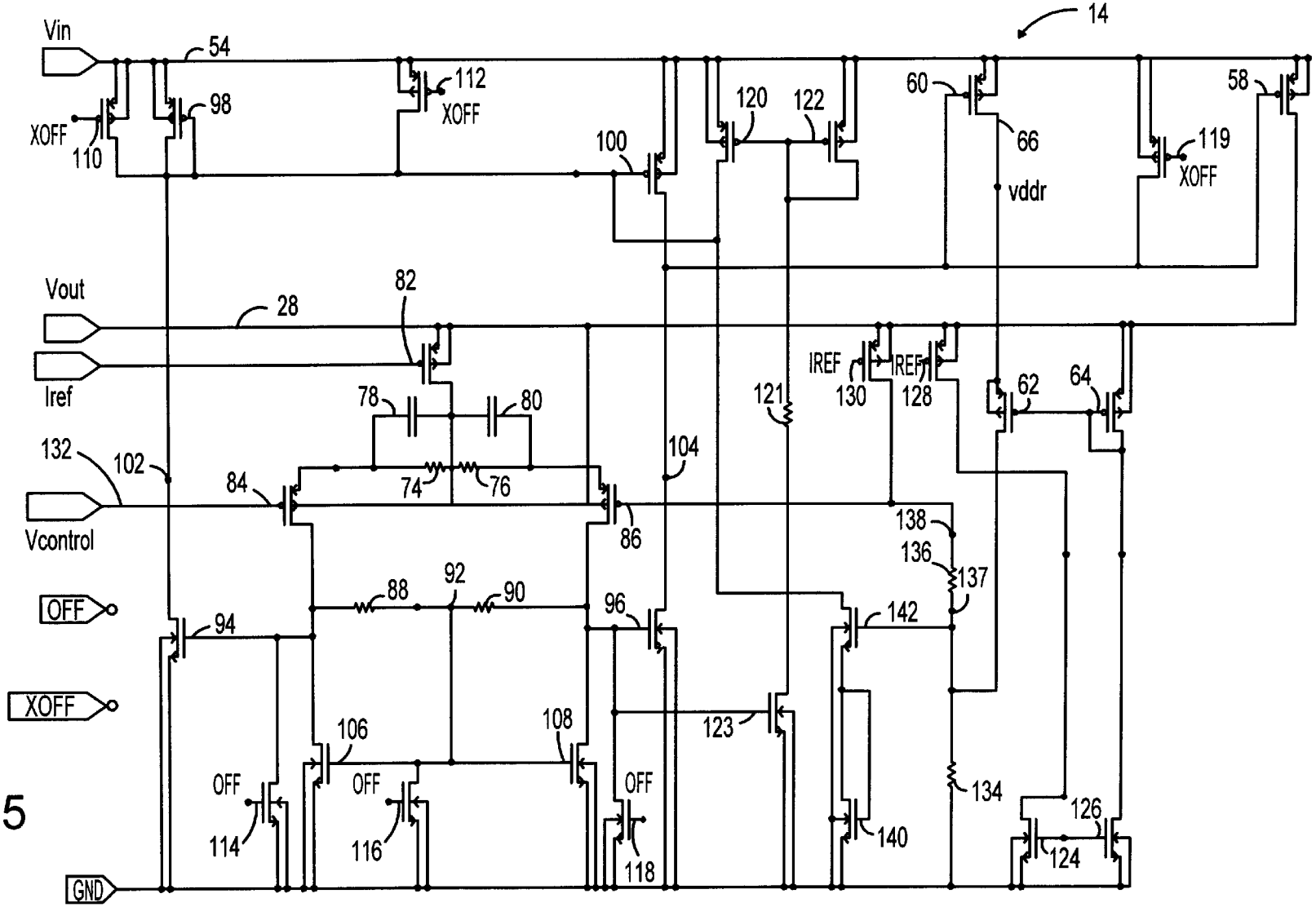
FIG. 5 is a more detailed schematical diagram of the second gain stage of FIG. 4.

An offset bias is provided by a current source 68. Referring to FIGS. 4 and 5, current is sensed using a current sense resistor 134. When the voltage at the gate of the transistor 142 exceeds two NMOS thresholds, the circuit goes into current limit. In one embodiment, this limit is approximately 400 mA. Otherwise, resistor 134 is used to sense the current in the output device 58, as described.

In FIG. 5, devices 98, 100, 82, 78, 80, 84, 86, 74, 76, 88, 90, 94, 96, 123, 122, 120, 106 and 108 comprise the differential amplifier which forces the voltage at Vcontrol 132 to be equal to the voltage at node 138, which reflects the current sense voltage at node 137 with an offset that is a function of the voltage across resistor 136.

One embodiment of the circuitry of FIG. 4 is shown in FIG. 5. The fully differential push-pull amplifier 52 of FIG. 4 includes a pair of gain reduction resistors 74 and 76 that are in parallel with a pair of capacitors 78 and 80 to form a zero in the amplifier gain curve. This zero is unrelated to the zero described above with reference to the error amplifier. This allows the second gain stage to operate to nearly 10 MHz, which is important in overall device operation. The parasitic capacitance has little bearing on the operation of the circuit.

At the input side of the differential push-pull amplifier is a current bias transistor 82. The push-pull amplifier also includes a pair of differential input transistors 84 and 86. Amplification and current mirroring are accomplished with a pair of equivalent resistors 88 and 90. The resistors establish a differential voltage at a node 92 and set the gain for the output. In this manner, the two resistors 88 and 90 provide a common mode bias for the next stage, which is formed of a pair of NMOS devices 94 and 96. The NMOS devices couple the output stage through PMOS transistors 98 and 100 connected to the Vin rail 54. This is the only connection in the feedback path in which Vin is used. The nodes 102 and 104 have low capacitive coupling to electrical ground, such that transients on Vin will not significantly affect the gate voltage on the output pass transistor 58 that was previously described with reference to FIG. 4.

The two NMOS transistors 94 and 96 are used for the push-pull operation. The transistors are alternatively activated to source and sink significant current for driving the heavy capacitance of the output pass transistor 58. A pair of transistors 106 and 108 provide the desired bias. The fully differential front stage also includes a number of turn-off transistors 110, 112, 114, 116, 118 and 119. Moreover, there is a current mirror formed by transistors 120 and 122 to increase the speed of turn-off of node 102, thereby enhancing performance of the fully differential push-pull amplifier. Resistor 121 and transistor 123 are used in the operation of the current mirror.

The small and large current mirror devices 58 and 60 and the cascode transistors 62 and 64 of FIG. 4 are also shown in FIG. 5. The current source 68 of FIG. 4 is formed by three transistors 124, 126 and 128. An offset bias is provided by a current source transistor 130, which maintains the voltage on Vcontrol 132 in a positive state. Current is sensed by means of resistor 134 that is connected to the drain 72 of the cascode transistor 62. Node 138 is the second input to the push-pull amplifier 52 of FIG. 4.

There is considerable current gain in the circuitry of FIG. 5. For example, the gain may be several thousand. An over current signal is generated using transistors 140 and 142. When the voltage at the gate of device 142 exceeds two NMOS thresholds, the circuit goes into current limit. As previously noted, the limit may be approximately 400 mA.

The circuitry of FIG. 5 is an exemplary embodiment of the second gain stage 14 of FIG. 1. Other embodiments are contemplated, but the circuitry of FIG. 5 provides significant improvements over alternative embodiments. The utilization of the cascode transistors 62 and 64 reflects the output voltage to the drain 66 of the small current mirror transistor 60, thereby enhancing the accuracy of the current mirror. Moreover, a current sense signal is generated from the pilot device output. The current feedback is implemented in the voltage-to-current converter as a signal from the sense resistance of series resistors 134 and 136. Operations of the circuitry of FIG. 5 render the embodiment particularly suitable for use in the multi-pole voltage regulator 10 of FIG. 1.

What is claimed is:

1. A voltage regulator comprising:

a first gain stage having an error amplifier, said error amplifier having an error output voltage that is responsive to a difference between a reference input voltage and a feedback input voltage;

a second gain stage which is a transconductance amplifier being connected to receive said error output voltage, said transconductance amplifier including:

(a) a current mirror connected to provide at least a portion of a first conductive path from an input terminal to a low voltage terminal and a second conductive path from said input terminal to an output terminal; and (b) current-controlling means for regulating an output current through said second conductive path, said current-controlling means configured to compare said error output voltage with a first voltage at a node on said first conductive path to provide said regulation;

an output load connected to said transconductance amplifier to receive said output current to convert said output current into a regulated output voltage;

a feedback path connected to provide said feedback input voltage to said error amplifier, said feedback input voltage being responsive to said regulated output voltage; and a reference circuit to provide a constant reference voltage to said first gain stage.

2. The voltage regulator of claim 1 wherein said first gain stage and said reference circuit are connected to receive operating current from said regulated voltage.

3. The voltage regulator of claim 1 further comprising a start circuit connected to turn on said reference and said error amplifier when said regulated voltage is not present.

4. The voltage regulator of claim 1 wherein said error amplifier has a pole set at a first frequency and a zero set at a second frequency and wherein said load has a pole set at a third frequency, and wherein said second and said third frequencies are greater than said first frequency.

5. The voltage regulator of claim 4 wherein said transconductance amplifier has a pole set at a fourth frequency and a zero set at a fifth frequency and said load has a pole set at said third frequency, and wherein said third and fifth frequencies are greater than said fourth frequency.

6. The voltage regulator of claim 1 wherein said current mirror includes a first transistor and a second transistor, said first transistor being positioned on said first conductive path and said second transistor being positioned on said second conductive path, said first and second transistors being connected such that control nodes of said first and second transistors are coupled to said current-controlling means.

7. The voltage regulator of claim 6 wherein said first and second transistors are metal-oxide-semiconductor transistors.

8. The voltage regulator of claim 7 wherein said first and second transistors are P-channel metal-oxide-semiconductor transistors that are connected such that sources of said first and second transistors are coupled to said input terminal, a drain of said first transistors is coupled to said low voltage terminal, a drain of said second transistor is coupled to said output terminal, and gates of said first and second transistors are coupled to said current-controlling means.

9. The voltage regulator of claim 1 wherein said current-controlling means includes a differential amplifier having two inputs connected to receive said error output voltage and said first voltage and an output to transmit a current control voltage to said current mirror for said regulation of said output current.

10. The voltage regulator of claim 1 wherein said transconductance amplifier further includes a current source connecting said output terminal to said low voltage terminal.

11. The voltage regulator of claim 10 wherein said current source is comprised of a plurality of metal-oxide-semiconductor transistors.

12. The voltage regulator of claim 1 wherein said transconductance amplifier further includes a pair of cascoded transistors operatively associated with said current mirror.

13. The voltage regulator of claim 12 wherein said transconductance amplifier further includes a resistor on said first conductive path between one of said cascoded transistors and said low voltage terminal, said resistor effectuating a voltage difference across said resistor to provide said first voltage at said node.

14. The voltage regulator of claim 12 wherein said cascoded transistors are metal-oxide-semiconductor transistors.

15. A voltage regulator comprising:

a first conduction path from an input terminal to a low voltage terminal, said first conduction path having a first current;

a second conduction path from said input terminal to an output terminal, said second conduction path having a second current that is generally proportional to said first current;

signaling means connected to said output terminal for comparing the voltage at said output terminal to a reference voltage, said signaling means configured to generate an error signal in response to a difference between the voltage at said output voltage and said reference voltage; and current-controlling means for adjusting said second current by differentiating said error signal with the voltage at a node to regulate the voltage at said output terminal, said node being located on said first conduction path.

16. The voltage regulator of claim 15 further comprising a pass transistor on said first conduction path and a mirror transistor on said second conduction path, said pass and mirror transistors defining a current mirror in which control nodes of said pass and mirror transistors are coupled to said current-controlling means to facilitate said adjustment of said second current.

17. The voltage regulator of claim 16 further comprising a first cascoded transistor and a second cascoded transistor, said first cascoded transistor being connected between said mirror transistor and said low voltage terminal, said second cascoded transistor being connected between said pass transistor and said low voltage terminal.

18. The voltage regulator of claim 16 wherein said pass and mirror transistors are metal-oxide-semiconductor transistors.

19. The voltage regulator of claim 16 wherein said current-controlling means is a differential amplifier having a first input connected to said first conduction path at said node, a second input connected said signaling means, and an output connected to said control nodes of said pass and mirror transistors.

20. The voltage regulator of claim 15 wherein said signaling means is an error amplifier.

21. A method of providing a voltage regulation comprising steps of:

forming a current mirror having a first current through a first leg of said current mirror and a second current through a second leg of said current mirror, said second current having a magnitude that partially defines an output voltage;

generating an error signal in response to a comparison of said output voltage to a reference voltage;

differentiating said error signal with a first voltage at a node on said first leg of said current mirror; and adjusting a current flow through said current mirror to change said magnitude of said second current being drawn through said second leg of said current mirror in response to said differentiation of said error signal with said first voltage, said change in said magnitude of said second current effectuating said voltage regulation of said output voltage.

22. The method of claim 21 wherein said step of differentiating said error signal with said first voltage includes employing a differential amplifier having a first input and a second input, said first input being connected to said first leg of said current mirror at said node to receive said first voltage, said second input being connected to an error amplifier to receive said error signal.

23. The method of claim 22 wherein said step of adjusting said current flow through said current mirror includes transmitting a control signal from said differential amplifier to control nodes of two transistors that define said current mirror, said control signal being a result of said differentiation of said error signal with said first voltage.

24. The method of claim 22 further comprising a step of compensating any voltage dependency of said current mirror by employing a plurality of cascoded transistors.

* * * * *